United States Patent [19]

Faulkner

[11] 4,060,747

[45] Nov. 29, 1977

[54] PHOTOTUBE HAVING DOMED MESH WITH NON-UNIFORM APERTURES

[75] Inventor: Richard Dale Faulkner, Lancaster, Pa.

[73] Assignee: RCA Corporation, New York, N.Y.

[21] Appl. No.: 655,165

[22] Filed: Feb. 4, 1976

[51] Int. Cl.[2] ..... H01J 39/00; H01J 39/04

[52] U.S. Cl. ..... 313/95; 313/99

[58] Field of Search ..... 313/95, 103, 104, 105, 313/99, 94, 102; 250/213 VT

[56] References Cited

U.S. PATENT DOCUMENTS

| | | | |
|---|---|---|---|
| 2,908,840 | 10/1959 | Anderson | 313/95 |
| 3,849,644 | 11/1974 | Ibaugh | 313/105 X |

*Primary Examiner*—Robert Segal

*Attorney, Agent, or Firm*—G. H. Bruestle; D. N. Calder

[57] ABSTRACT

An electron discharge tube comprises a photocathode, a dynode, a mesh having openings of non-uniform sizes on the dynode, and an anode, all in an evacuated tube. The mesh comprises a plurality of spaced first elongated elements of electrically conducting material and a plurality of spaced second elongated elements of electrically conducting material, intersecting to form openings of non-uniform sizes.

9 Claims, 6 Drawing Figures

PHOTOTUBE HAVING DOMED MESH WITH NON-UNIFORM APERTURES

BACKGROUND OF THE INVENTION

The present invention relates to a mesh and more particularly to a mesh having varying degrees of electron permeability over its surface used in an electron discharge tube.

Meshes on dynodes used in electron discharge tubes are well known in the art. Heretofore, such meshes have been made from a network of conducting elements intersecting to openings of uniform sizes. The easiest, simplest and most widely used mesh is a planar network composed of mutually orthogonal rectilinear conducting elements. In general a mesh must serve two functions. The first is to permit the passage of primary electrons through the mesh to impinge on the active area of the dynode. The second function is to provide a field within the cavity of the dynode to direct the secondary electrons released from the dynode onto the next dynode or anode. In creating the cavity, the mesh must shield the secondary electrons from the field of the source of primary electrons.

These two functions, however, are highly competitive and compromises are often made. At one extreme if one desired solely to have all the primary electrons impinge on the dynode, then no mesh ought to be placed in the path of the primary electrons. The mere presence of a member, even though full of openings, in the path of the primary electrons raises the probability of a primary electron hitting the mesh and being deflected or stopped from impinging on the dynode. However, the absence of a mesh, means that no secondary electrons can be released from the dynode, because the field of the source of the primary electrons is negative compared to the dynode. This negative field prevents the release of secondary electrons from the dynode. At the other extreme, if one desired solely to have all the secondary electrons directed to the next dynode or anode, and to shield all of the secondary electrons from the field of the source of primary electrons then a conducting plane ought to be placed in the path of the primary electrons to stop all of the field of the source of primary electrons. This, of course, means that no primary electron would ever be incident upon the dynode. Heretofore, because meshes have been planar networks comprising mutually orthogonal rectilinear conducting elements forming uniform openings, the size of the opening or the optical transmissive per unit area of the mesh has been the means by which the mesh can be adjusted to accomodate the two competing functions. The adjustment of the opening size however is accomplished while maintaining the uniformity of the size of the openings.

SUMMARY OF THE INVENTION

An electron discharge tube comprises a photocathode, a dynode, a mesh having openings of non-uniform sizes on the dynode, and an anode, all in an evacuated envelope. The mesh comprises a plurality of spaced first elongated elements of electrically conducting material, and a plurality of spaced second elongated elements of electrically conducting material intersecting to form openings of non-uniform sizes.

DETAILED DESCRIPTION OF THE DRAWINGS

Figure 1:
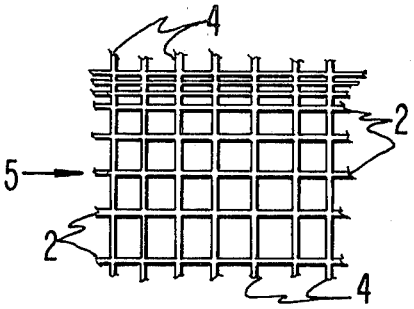
FIG. 1 is a plan view of one embodiment of a mesh used in the electron discharge tube of the present invention.

Referring to FIG. 1, there is shown an embodiment of a mesh, generally designated as 5, used in the electron discharge tube of the present invention. The mesh 5 is a planar mesh. The planar mesh 5 comprises a plurality of spaced first elongated elements 4 and a plurality of spaced second elongated elements 2 intersecting to form openings of non-uniform sizes. The first elements 4 are parallel to one another and the second elements 2 are parallel to one another. The first elements 4 and the second elements 2 are mutually orthogonal to one another. The first elements 4 are uniformly spaced apart from one another, whereas the second elements 2 are non-uniformly spaced apart.

The first elements 4 and the second elements 2 must be of an electrically conducting material, such as a metal. The first elements 4 and the second elements 2 can be wires or strips of metals or other conductors. The planar mesh 5 can be made by soldering wires or strips of metals together or by etching apertures of non-uniform sizes in a planar metal member.

Figure 2:
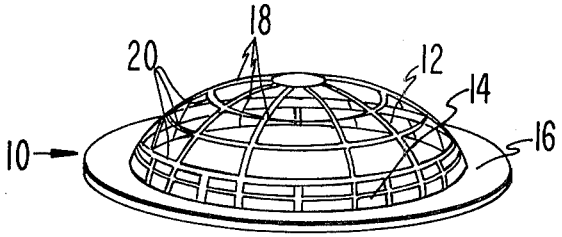
FIG. 2 is a perspective view of another embodiment of a mesh used in the electron discharge tube of the present invention.

In FIG. 2 there is shown another embodiment of a mesh, generally designated as 10, used in the electron discharge tube of the present invention. The non-planar mesh 10 comprises a central portion 12, a peripheral portion 14, and an annular ring 16. The central portion 12 and the peripheral portion 14 form a radially symmetric dome. The central portion 12 is a network of radial elongated elements 18 and circumferential elongated elements 20 intersecting to form openings of non-uniform sizes. The peripheral portion 14 also is a network of radial elongated elements 18 and circumferential elongated elements 20 intersecting to form openings of non-uniform sizes. The central portion 12 however is more electron permeable than the peripheral portion, i.e. the size of the openings is larger in the central portion 12 than in the peripheral portion 14. This means that in the central portion 12 of the non-planar mesh 10 an electron has a lower probability of being deflected or stopped than in the peripheral portion 14 of the non-planar mesh 10. The annular ring 16 is attached to and is around the circumference of the peripheral portion 14.

The radial elements 18 and the circumferential elements 20 must be of an electrically conducting material such as a metal. The annular ring 16 is for support purpose only and can also be made from any conducting material, preferably the same metal as is used for the radial elements 18 and the circumferential elements 20. The non-planar mesh 10 can be made by etching apertures of non-uniform sizes in a planar metal member.

The etched metal member is then stretched to achieve the non-planar shape.

Figure 3:
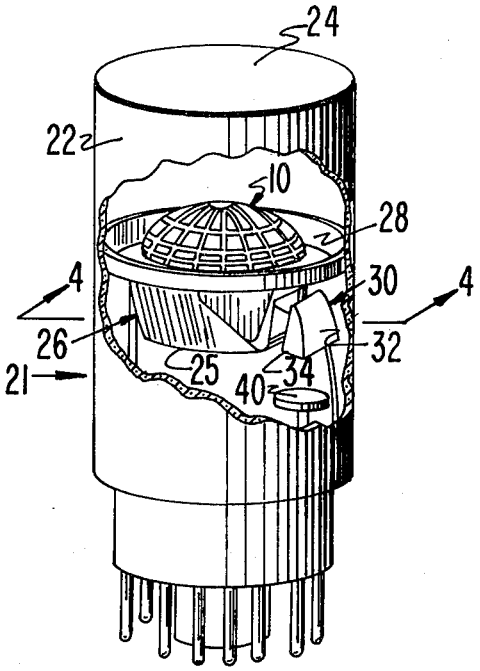
FIG. 3 is a cutaway perspective view of an electron discharge tube of the present invention.
Figure 4:
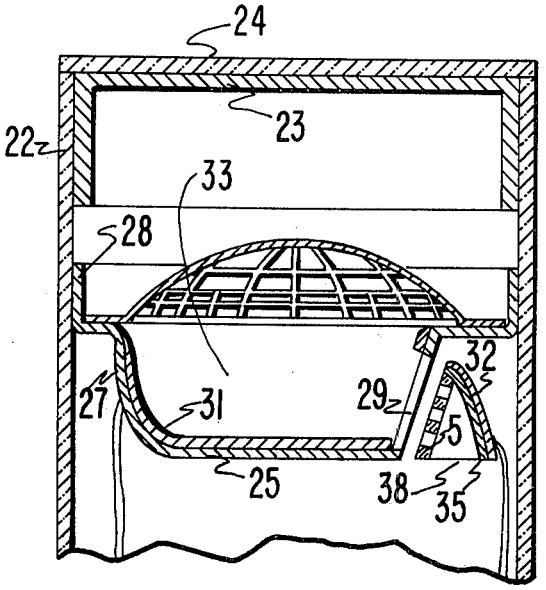
FIG. 4 is a partial cross-sectional view of FIG. 3 taken along plane 4—4.

Referring to FIGS. 3 and 4 there is shown an electron discharge tube 21 using the non-planar mesh 10 and the planar mesh 5. The electron discharge tube 21 comprises a cylindrical body 22 and a circular face plate 24. A photocathode 23 (see FIG. 4) is on the face plate 24 in the tube 21 and is also along a portion of the cylindrical body 22 adjacent to the face plate 24. Within the tube 21 the non-planar mesh 10 is on a first dynode 26. The first dynode 26 is cup shaped having an approximate circular top opening 33. A circular flange 28 is around the periphery of the top opening 33. The first dynode 26 includes a flat base 25 and a side wall 27 enclosing the base. A side opening 29 is in the side wall 27, near the periphery of the top opening 33 and substantially perpendicular to the top opening 33. The inside of the first dynode 26 is lined with electron emissive material 31 (see FIG. 4). The top opening 33 with the flange 28 around the periphery thereof faces the photocathode 23, such that the plane of the top opening 33 is substantially parallel to the plane of the photocathode 23. Moreover, the diameter of the circular flange 28 is substantially equal to the diameter of the cylindrical body 22. The annular ring 16 of the non-planar mesh 10 rests on the flange 28. The central portion 12 of the non-planar mesh 10 is closer to the photocathode 23 than the peripheral portion 14 of the non-planar mesh 10, i.e. the non-planar mesh 10 is concaved to the photocathode 23.

A second dynode 30 is laterally adjacent to the first dynode 26 in the tube 21. The second dynode is a box shaped dynode. The box dynode 30 comprises a curved surface 32, and two side walls 34 each perpendicularly attached to the curved surface 32 (only 1 is shown in FIG. 3). Electron emissive material 35 is on the inside surface of curved surface 32. The planar mesh 5 is attached to the curved surface 32 and the two side walls 34 (see FIG. 4). A bottom opening 38 is formed by the planar mesh 5, the two side walls 34 and the curved surface 32. The planar mesh 5 is more electron permeable near the bottom opening 38 than near the curved surface 32, i.e. the openings of the planar mesh 5 are larger near the bottom opening 38 than near the curved surface 32. The box dynode 30 lies below the flange 28 of the first dynode 26 with the bottom opening 38 in the plane of the base 25. The planar mesh 5 is substantially parallel to the side opening 29. Finally an anode 40 lies below the bottom opening 38.

Figure 5:
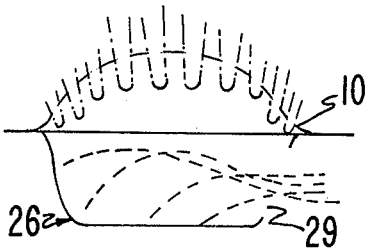
FIG. 5 is a schematic view of a non-planar mesh on a dynode.

The theory of operation of the non-planar mesh 10 and its advantage can be seen by referring to FIG. 5. In FIG. 5 a schematic view of a non-planar mesh 10 on a cup dynode 26 is shown. The dotted lines represent trajectories of secondary electrons released by the cup dynode 26 as they exit via side opening 29. As it was previously discussed, the function of any mesh is to maximize the number of primary electrons impinging on the dynode and to minimize the effect of the electric field of the source of primary electrons on the secondary electrons exiting from the dynode. The former function has been heretofore accomplished by increasing the size of the openings of the mesh, i.e. make the mesh more optically transmissive per unit area. However, by increasing the size of the openings, one also increased the electric field from the source from which the primary electrons came. The field is shown as a dash-dot-dash line. Since this field is negative compared to the dynode, the secondary electrons are inhibited by this field from leaving the dynode. In the non-planar mesh 10 the opening of the central portion 12 is increased to permit more primary electrons to impinge on the dynode 26. However, this is accompanied by moving the central portion 12 further away from the dynode 26 to minimize the effect of the electric field from the source of the primary electrons on the secondary electrons. Typically, a planar mesh having uniform size openings, and which does not adversely effect the trajectory of secondary electrons, is 88% optically transmissive. By making the central portion 12 more electron permeable than the peripheral portion 14 and by moving the central portion 12 further away from the dynode 26 than the peripheral portion 14 to reduce the effect of the increased field on the trajectory of the secondary electrons, the non-planar mesh 10 of the present invention is approximately 98% optically transmissive.

Figure 6:
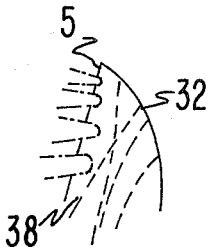
FIG. 6 is a schematic view of a planar mesh on a dynode.

The theory of operation of the planar mesh 5 and its advantage can be seen by referring to FIG. 6. The theory of operation and the advantage of the planar mesh 5 is entirely analogous to the non-planar mesh 10. The planar mesh 5 is attached to the curved surface 32 at one end and is further away from the curved surface 32 near the bottom opening 38. By increasing the size of the opening and by moving the increased opening further away from the electron emissive surface, one has increased electron permeability or optical transmissiveness while at the same time not increased the effect of the field (shown as dash-dot-dash lines) from the source of the primary electrons on trajectory of the secondary electrons (shown as dotted lines).

What is claimed is:

1. An electron discharge tube comprising an evacuated tube; a photocathode in said tube; a dynode having a covered input opening and an output opening in said tube; a dome-shaped radially symmetric mesh covering said input opening, said mesh having a plurality of spaced first elongated elements of electrically conducting material, and a plurality of spaced second elongated elements of electrically conducting material, said first elements and said second elements intersecting to form non-uniform apertures; said mesh further comprising a center and a periphery; said first elements being substantially radial elements; and said second elements being substantially circumferential elements; said apertures being progressively larger from the periphery to the center of said mesh whereby said central portion is more electron permeable than the peripheral portion.

2. The electron discharge tube of claim 1 wherein said non-planar mesh further includes an annular ring attached to said peripheral portion.

3. The electron discharge tube of claim 2 wherein said dynode is a cup dynode, comprising a cup shaped member having an approximate circular top opening;

a circular flange around the periphery of said top opening;

a side opening near the periphery of said top opening substantially perpendicular to said top opening;

electron emissive material on the inside of said dynode;

said dynode in said tube with said top opening facing said photocathode; and said dome-like mesh on said top opening with said central portion closer to said photocathode than said peripheral portion.

4. An electron discharge tube comprising an evacuated tube having therein: a photocathode; a cup-shaped dynode and an anode; a dome-shaped mesh in contact with said dynode, said mesh comprising a plurality of spaced elongated elements of electrically-conducting material, said first elements and said second elements intersecting to form openings of non-uniform size; said mesh being radially symmetric wherein said first elements are radial elements and said second elements are circumferential elements; said mesh further comprising a central portion and a peripheral portion; said mesh further comprising an annular ring attached to said peripheral portion; said dynode having an approximately circular top opening; a circular flange around the periphery of said top opening; a side opening near the periphery of said top opening substantially perpendicular to said top opening; electron emissive material on the inside of said dynode; said top opening facing said photocathode; said dome-shaped mesh being on said top opening with said central portion being closer to said photocathode than said peripheral portion; said evacuated tube including a faceplate and a tubular body with a portion of the body having a circular cross-section; said photocathode being on said faceplate; and said dynode located in the portion of the tubular body having the central cross-section, the flange of the dynode being substantially parallel to the plane of the circular cross-section and having a diameter substantially the same as the diameter of the circular cross-section; whereby said central portion is more electron permeable than said peripheral portion.

5. The electron discharge tube of claim 4 wherein said dynode includes a flat base and a side wall enclosing said base.

6. The electron discharge tube of claim 5 further including a box and grid dynode in said tube;

said box and grid dynode having a curved surface; two side walls each attached perpendicularly to the curved surface; a planar grid attached to the curved surface and the two side walls; a bottom opening formed by the grid, the two side walls and the curved surface; and electron emissive material on the interior surface of the curved surface; and said box and grid dynode positioned with said grid substantially parallel and laterially adjacent to said side opening of said cup shaped dynode.

7. The electron discharge tube of claim 6 wherein said box and grid dynode is positioned between the flange of the cup shaped dynode and a plane of the base of the cup shaped dynode.

8. The electron discharge tube of claim 7 wherein said bottom opening lies in the plane of the base of the cup shaped dynode.

9. The electron discharge tube of claim 8 wherein said planar grid is less electron permeable near the curved surface than near the bottom opening.

* * * * *